United States Patent [19]

McGurran

[11] Patent Number: 5,030,496

[45] Date of Patent: Jul. 9, 1991

[54] LOW DENSITY NONWOVEN FIBROUS SURFACE TREATING ARTICLE

[75] Inventor: Jon P. McGurran, St. Paul, Minn.

[73] Assignee: Minnesota Mining and Manufacturing Company, St. Paul, Minn.

[21] Appl. No.: 350,049

[22] Filed: May 10, 1989

[51] Int. Cl.[5] ..... A47L 11/164; A47L 13/10; B24D 11/00; B32B 5/28

[52] U.S. Cl. ..... 428/85; 15/209 C; 15/230.12; 428/87; 428/96; 428/97; 428/283; 428/288; 428/290; 428/361; 428/362

[58] Field of Search ..... 15/209 C, 230.12; 427/389.9; 428/85, 87, 96, 97, 283, 288, 290, 361, 362

[56] References Cited

U.S. PATENT DOCUMENTS

| | | | |
|---|---|---|---|
| 2,532,248 | 11/1950 | Upper et al. | 15/230.12 |
| 2,958,593 | 11/1960 | Hoover et al. | 15/209 C |
| 3,075,222 | 1/1963 | Miller | 15/230.12 |
| 3,177,055 | 4/1965 | Ruckle et al. | 15/230.12 |
| 3,254,357 | 6/1966 | Caul et al. | 15/230.12 |
| 3,537,121 | 11/1970 | McAvoy | 15/230.12 |
| 3,800,013 | 3/1974 | Allan | 264/52 |
| 4,437,271 | 3/1984 | McAvoy | 15/230.12 |
| 4,609,380 | 9/1986 | Barnett | 51/298 |

*Primary Examiner*—James C. Cannon

*Attorney, Agent, or Firm*—Gary L. Griswold; Walter N. Kirn; Richard Francis

[57] ABSTRACT

A flexible and resilient, nonwoven, surface treating article formed of entangled synthetic fibers bonded together at points where they contact one another by a binder resin comprising plasticized vinyl resin and polymerized amine-formaldehyde derivative.

25 Claims, No Drawings

LOW DENSITY NONWOVEN FIBROUS SURFACE TREATING ARTICLE

TECHNICAL FIELD

The invention relates to low density nonwoven fibrous surface treating articles for cleaning, buffing or polishing surfaces.

BACKGROUND OF THE INVENTION

Low density, open, lofty and resilient nonwoven surface treating products have been widely used for cleaning, buffing and polishing objects such as cooking utensils, kitchen appliances, household fixtures, walls and floors. Nonwoven products suitable for these purposes have been made according to the teachings of Hoover et al. in U.S. Pat. No. 2,958,593 and McAvoy in U.S. Pat. No. 3,537,121, and have found wide acceptance for both industrial and home use.

Typically, these nonwoven cleaning, buffing and polishing products are formed of an open, lofty, nonwoven matrix of crimped, synthetic, organic staple fibers which are bonded together at points where they contact one another. Generally, resinous binders are used, and often these contain fillers, pigments and abrasive particles.

The resinous binders currently being used in the manufacture of such products typically are applied as either aqueous or organic solvent solutions. However, with the increasing concern for environmental quality, employee safety, and costs, organic solvent based systems have become less acceptable. Furthermore, high water content binder systems generally require more energy to cure than organic solvent based systems and are also less than desirable. Aside from these considerations, the choice of binder has also been largely controlled by the type of fibers used to form the matrix.

Polyester staple fibers, even though significantly less expensive than nylon staple fibers, have not been universally accepted for use in the nonwoven matrix of these cleaning, buffing and polishing products because of the limited adherence of many of the commonly used binder resins to polyester. For example, phenol formaldehyde resins, which have been widely used to bond nylon fiber matrices in nonwoven abrasive and polishing products, typically have not been used as the primary binder for polyester fiber matrices because the cured resin does not adhere well to polyester. Although polyester nonwoven abrasive products bonded with a phenol formaldehyde binder resin have an excellent initial appearance after fabrication, they typically shed resin and fibers, and become excessively thinned and limp shortly after the commencement of their use in cleaning or polishing applications. Furthermore, when water based latex binders have been used as binders for polyester nonwoven matrices, the resultant products are limited in their field of useful applications as these binders have poor resistance to chemical cleaners and the like. Therefore, to be used successfully in such cleaning, buffing and polishing articles, polyester fibers have generally required a more costly, organic solvent based resinous binder.

One significant commercial application for the nonwoven cleaning, buffing and polishing products described above is in the polishing pads used with floor polishing machines However, the advent of ultra high speed floor polishing machines, which operate at a polishing pad speed ranging from about 1000 to about 3200 revolutions per minute, have placed new demands upon the performance of nonwoven floor polishing pads. So too has the requirement that polish coated floors have a gloss level which gives the optical illusion that the floor is wet or has the "wet look". In order to meet these demands a floor polishing pad must, in addition to cleaning the floor of lightly adhered soil, quickly buff the polish coated floor to a high luster without imparting swirl marks. Furthermore, when in use, the pad must not transfer or smear onto the floor, or experience excessive drag causing the floor polishing machine to operate at a lower speed and become overloaded.

SUMMARY OF THE INVENTION

The present invention provides a flexible and resilient, fibrous, surface treating article comprising an open, lofty, nonwoven fibrous web formed of entangled, synthetic, organic fibers bonded together at points where they contact one another by a cured, tough, fracture resistant, substantially homogeneous, primary binder resin comprising plasticized vinyl resin and polymerized amine-formadehyde derivative. The primary binder resin of the invention can be formed by thermally curing a mixture comprising: (a) a vinyl resin; (b) a plasticizer for the vinyl resin which, upon exposure to elevated temperatures, fuses with the vinyl resin to form a substantially homogeneous plasticized vinYl resin; (c) an amine-formaldehyde derivative which will undergo condensation polymerization under acidic conditions at a temperature below the decomposition temperature of the vinyl resin; and (d) an acid catalyst which initiates the condensation polymerization upon exposure to elevated temperatures below the decomposition temperature of the vinyl resin.

Additionally, when a more abrasive nonwoven article is desired, particles of abrasive material may be dispersed throughout and adhered to the fibers of the web. This may be accomplished by a number of conventional methods. For example, the abrasive material may be dispersed throughout the uncured primary binder resin mixture prior to its application to the web. Alternatively, the particles of abrasive material may be dispersed throughout a secondary binder resin composition, which differs in composition from the primary binder resin, and which is applied to the primary binder resin coated web subsequent to the curing of the primary binder resin.

The nonwoven article of the invention provides numerous advantages over conventional nonwoven products. For example, the article of the invention can be made with resinous binder compositions which contain virtually no water or organic solvents. This is advantageous in that it reduces both the potential health risk associated with the emission of solvent vapors into the environment, and also the energy and time required for curing the binder. Liquid resinous coatings containing large amounts of water usually cannot be cured quickly, requiring excessive amounts of energy and extended drying times to remove the water.

Furthermore, the nonwoven article of the invention can effectively and economically utilize lower cost polyester fibers in the formation of the web. Unlike the phenol formaldehyde resinous binders used extensively in the manufacture of conventional nonwoven surface treating articles from nylon fibers, the primary binder resin of the invention adheres strongly to the surface of polyester fibers and provides a nonwoven article, formed of polyester fibers, having sufficient integrity to be used for extended periods of time without suffering unacceptable amounts of resin or fiber loss. Additionally, the primary binder resin of the invention provides a good intermediate pre-bond layer for enhancing the adherence of subsequent coatings of stronger binder materials, such as conventional water-based phenol formaldehyde resins, which do not themselves adhere well to the surface of polyester fibers.

The nonwoven article of the invention finds utility in a wide variety of applications, such as the removal of soil or corrosion from surfaces, the smoothing of rough or scratched surfaces, and the polishing of dull surfaces to a high luster. Typical applications include the cleaning of cooking utensils, dishes, walls, counter tops and the like; the cleaning and polishing of floors; and the smoothing and polishing of the surfaces of metal, wood, plastic and ceramic articles. The suitability of the article for a particular application is mainly determined by the abrasive character of the article. Articles intended to be more abrasive will generally have larger, harder, and/or a greater quantity of abrasive particles adhered to the fibers. Articles intended to be used for polishing and cleaning surfaces typically will have smaller, softer, and/or fewer abrasive particles adhered to the fibers, and in some cases may have no abrasive material at all.

The open, lofty, nonwoven article of the invention is especially suited as a floor polishing pad for use with ultra high speed floor polishing machines. These floor polishing pads are more effective at restoring a high luster to dull polish coated flooring than conventional nonwoven floor polishing pads.

DETAILED DESCRIPTION OF THE INVENTION

The open, lofty, nonwoven article of the present invention is preferably made from crimped, staple, synthetic, organic fibers such as nylon and polyester fibers. These crimped, staple fibers can be processed and entangled into nonwoven webs by conventional web-forming machines such as that sold under the tradename "Rando Webber" which is commercially available from the Curlator Corporation. Methods useful for making the nonwoven webs of the invention from crimped, staple, synthetic fibers are disclosed by Hoover et al. in U.S. Pat. No. 2,958,593 and by McAvoy in U.S. Pat. No. 3,537,121, which are incorporated herein by reference.

In the preparation of the open, lofty, nonwoven surface treating article of the invention, a nonwoven fibrous web can be coated with a liquid resinous composition, which cures to form the primary binder resin, comprising a vinyl resin dispersed in a compatible plasticizer, a compatible liquid amine-formaldehyde derivative which undergoes condensation polymerization under acidic conditions at a temperature below the decomposition temperature of the vinyl resin, and an acid catalyst capable of initiating the condensation polymerization under elevated temperature conditions. The web may be coated with this liquid resinous composition by any method known in the art, such as roll coating or spray coating. Furthermore, the liquid resinous coating composition is stable, remaining liquid under ambient conditions, and it can be used in the manufacture of nonwoven articles for several days after its preparation.

The vinyl resin used in the invention is a thermoplastic polymer, which, in combination with a suitable plasticizer, is capable of being formed into a continuous coating of a substantially homogeneous plasticized vinyl resin by the application of heat. Vinyl resins useful in the present invention include homopolymers of vinyl chloride and copolymers of vinyl chloride with comonomers such as vinyl acetate, vinylidene chloride, vinyl esters such as vinyl propionate and vinyl butyrate, as well as alkyl-substituted vinyl esters. Additionally, copolymers of vinyl chloride with acrylic comonomers such as acrylic acid, methacrylic acid, and the alkyl esters thereof, may be useful in the present invention. However, vinyl resins composed of homopolymers of vinyl chloride or copolymers of vinyl chloride with vinyl acetate are preferred. One such preferred vinyl resin is the vinyl acetate/vinyl chloride copolymer dispersion resin commercially available from the Occidental Chemical Corporation under the trade designation Oxy 565.

The plasticizer used in the present invention should be chosen to provide a substantially homogeneous plasticized vinyl resin upon the application of heat. Preferably the plasticizer is a low to medium viscosity liquid into which the vinyl resin can be dispersed to form a dispersion which is stable for extended periods of time. Plasticizers useful in the present invention include those commonly employed to form plasticized polyvinyl chloride and include phthalate esters, such as 2-ethyl hexyl phthalate, dibutyl phthalate, dioctyl phthalate, and diisononyl phthalate; similar azelate or adipate esters; phosphate esters such as tricresyl phosphate; and mixtures thereof.

The amount of the plasticizer used in the liquid resinous composition should be sufficient to form a fluid dispersion of the vinyl resin and facilitate fusion of the vinyl resin upon the application of heat. Preferably the fluid dispersion flows easily so as to facilitate the coating of the open, lofty, nonwoven web. However, excessive amounts of the plasticizer may cause the plasticized vinyl resin to be too soft to produce a primary binder resin having sufficient durability and strength to be useful in the invention. Furthermore, excessive amounts of plasticizer may even cause the plasticizer to bleed from the plasticized vinyl resin of the primary binder and result in the undesirable formation of a liquid film of plasticizer on the surface of the article. Typically, the plasticizer and vinyl resin are present in the liquid resinous composition in a weight ratio of plasticizer to vinyl resin ranging from about 30:70 to about 60:40. Preferably the weight ratio of plasticizer to vinyl resin is in the range from about 35:60 to about 55:45.

The amine-formaldehyde derivative useful in the present invention will undergo condensation polymerization upon being heated, in the presence of a strong acid catalyst, to a temperature below the decomposition temperature of the vinyl resin. Additionally, the amine-formaldehyde derivative is compatible with the liquid vinyl resin/plasticizer dispersion before the application of heat. Preferably, the amine-formaldehyde derivative is a liquid which dissolves in, or which can be dispersed in the vinyl resin/ plasticizer dispersion to form a substantially homogeneous mixture. Furthermore, after the application of heat, which concurrently causes the solidification or fusion of the vinyl resin/plasticizer dispersion and the condensation polymerization of the amine-formaldehyde derivative, the plasticized vinyl resin and the polymerized amine-formaldehyde resin form a substantially homogeneous solid showing almost no incompatibility or significant phase separation.

Amine-formaldehyde derivatives suitable for use in this invention can be made by reacting formaldehyde with polyamine functional materials such as melamine, urea, or benzoguanamine. Preferred amine-formaldehyde derivatives are fully methylated melamine-formaldehyde resins which have been alkylated to the extent that they have a low to very low free methylol content. Preferably the fully methylated melamine-formaldehyde resins are alkylated with lower molecular weight alkyl groups such as methyl, ethyl, or butyl groups. Examples of such preferred amineformaldehyde derivatives are commercially available from the American Cyanamide Company under the trade designations Cymel 301, Cymel 303, Cymel 1133 and Cymel 1168. These fully methylated melamine-formaldehyde resins have a low free methylol content and are compatible with the liquid vinyl resin/plasticizer dispersion. Cymel 303 is most preferred as it, in addition to having excellent compatibility with the vinyl resin dispersion, has good room temperature stability even when mixed with strong acids.

The weight ratio of the amine-formaldehyde derivative to the vinyl resin/plasticizer dispersion in the liquid resinous composition is preferably in the range from about 30:70 to about 65:35, and more preferably in the range from about 40:60 to about 60:40. However, selection of the preferred ratios is somewhat dependent on the ratio of the amount of vinyl resin to the amount of plasticizer in the vinyl resin/plasticizer dispersion. For example, a higher vinyl resin content may require less of the amine-formaldehyde derivative to provide the primary binder resin with sufficient durability and strength to be useful. Conversely, a higher plasticizer content may require more of the amine-formaldehyde derivative.

Condensation polymerization of the amine-formaldehyde derivative is initiated, at elevated temperatures, by an acid catalyst which may be either a strong acid or a compound that generates a strong acid at elevated temperatures below the decomposition temperature of the vinyl resin. Examples of strong acids which are suitable as the acid catalyst of the invention include benzene sulfonic acid, p-toluene sulfonic acid, formic acid, trifluoroacetic acid, tribromoacetic acid, and other compounds well known in the art. A preferred acid catalyst is p-toluene sulfonic acid.

The formation of the primary binder resin of the invention, by the solidification of the fused vinyl resin plastisol and the concurrent condensation polymerization of the amine-formaldehyde derivative, occurs at elevated temperatures below the decomposition temperature of the vinyl resin. Preferably the formation of the primary binder resin occurs at temperatures between about 135° C. and about 190° C. At these temperatures, the binder coating will typically solidify in periods ranging from about 5 to about 25 minutes. Although solidification of the binder resin may occur more rapidly at higher temperatures, excessively high temperatures can cause deterioration of the binder resin or the fibers of the nonwoven web.

Where the open, lofty, nonwoven cleaning and polishing article of the invention is required to be more abrasive, abrasive particles may be dispersed throughout and adhered to the fibers of the nonwoven web. Useful abrasive particles may range in size anywhere from about 24 grade, average particle diameter of about 0.71 mm, to about 1000 grade, average particle diameter of about 0.01 mm.

Depending upon the desired application, the abrasive materials used in the article of the invention may be a soft abrasive, a hard abrasive or a mixture thereof. Soft abrasives, having a Mohs hardness in the range of from about 1 to 7, provide the article with a mildly abrasive surface. Examples of useful soft abrasives include such inorganic materials as garnet, flint, silica, pumice and calcium carbonate; and such organic polymeric materials as polyester, polyvinyl chloride, methacrylate, methylmethacrylate, polymethylmethacrylate, polycarbonate and polystyrene. Hard abrasives, those having a Mohs hardness greater than about 8, provide the article with a more aggressive abrasive surface. Examples of useful hard abrasives include such materials as silicon carbide, corundum, aluminum oxide, topaz, fused alumina-zirconia, boron nitride, tungsten carbide and silicon nitride.

The abrasive particles may be adhered to the fibers of the web by the primary binder resin, or by a secondary binder resin which differs in composition from the primary binder resin and which is applied after the primary binder resin has cured. In the mildly abrasive articles, which are typically used in low-speed, hand-powered operations, it is generally preferred that the soft abrasive particles be adhered to the fibers by the primary binder resin. In such articles the primary binder resin has sufficient strength and durability to provide the mildly abrasive article with sufficient integrity to have a long and useful life. In the more aggressive abrasive articles, which are typically used in high-speed, machine-powered operations, it is generally preferred that the hard abrasive particles be adhered to the fibers by a hard, tough, secondary binder material, such as a phenol formaldehyde resin. Such secondary binder resin not only provides a stronger bond between the abrasive particle and the fiber, but increases the overall structural integrity of the nonwoven web as well.

The invention is further illustrated by the following non-limiting examples, wherein all parts are by weight unless otherwise specified.

EXAMPLE 1

A low density, nonwoven web was formed, on a Rando Webber web-forming machine, from a blend of fibers comprising 75% by weight, 50 mm long, 15 denier, crimped polyester (polyethylene terephthalate) staple fibers having about 9 crimps per 25 mm; and 25% by weight, 35 mm long, 15 denier, crimped, sheath-core, melt-bondable, polyester staple fibers having about 8 crimps per 25 mm and a sheath weight of about 50 percent. The formed web was then heated in a hot convection oven for 3 minutes at 160° C. to activate the melt-bondable fibers and prebond the web. The prebonded web weighed about 125g/m$^2$.

The pre-bonded web was then coated with a primary binder resin composition by passing it between the coating rolls of a two roll coater, wherein the bottom coating roll was partially immersed in the liquid binder resin composition. The liquid binder resin composition was a mixture of two pre-mixtures. The first pre-mixture was obtained by combining, with moderate stirring, 500 parts of a highly methylated melamine-formaldehyde resin having a very low methylol content (commercially available from the American Cyanamide Company under the trade designation Cymel 303) with 40 parts of a 50% solids solution in water of p-toluene sulfonic acid (a strong acid). The second pre-mixture was a vinyl resin/plasticizer dispersion obtained by mixing, under high shear mixing conditions, 430 parts diisononyl phthalate plasticizer to which was added slowly 570 parts of a fine granular polyvinylchloride-vinyl acetate copolymer dispersion resin (commercially available from Occidental Chemical Corporation under the trade designation Oxy 565). The liquid binder resin composition was produced by mixing 540 parts of the first pre-mixture into 1000 parts of the second pre-mixture, with moderate agitation. The liquid binder resin composition was applied to the nonwoven web, via the two-roll coater, at a rate of about about 115g/m$^2$. The liquid binder resin coated nonwoven web was then placed in an oven heated to 160° C for 10 minutes to cure the liquid binder resin and produce a bonded nonwoven web suitable for fabrication into a nonwoven abrasive product.

The bonded nonwoven web was then spray coated with an abrasive slurry composed of 16% base catalyzed phenol-formaldehyde resin, 3% pigments, 10% calcium carbonate, 50% grade 280 (average particle diameter of about 0.05 mm) and finer fused aluminum oxide abrasive particles, 5% isopropyl alcohol, and 16% water. The spray coating was first applied to one side of the web, cured, and then applied to the opposite side of the web, and again cured. Each spray coating was cured at 160° C. for about 15 to 20 minutes. The cured coated web weighed 665g/m$^2$ and was about 13mm thick.

CONTROL EXAMPLE A

A low density, pre-bonded, nonwoven web, formed of crimped polyester staple fibers and melt-bondable polyester staple fibers, was prepared as described above for Example 1. The pre-bonded, nonwoven web was then coated with the based catalyzed phenol formaldehyde resin slurry as described in Example 1. Aside from omission of the vinyl resin/melamine-formaldehyde resin coating, the product of this example was essentially the same as in Example 1.

COMPARATIVE PERFORMANCE

The products of Example 1 and Control Example A were evaluated for durability by folding and flexing a 100 mm by 150 mm pad of the nonwoven web of each example upon itself about 10 times. It was observed that the product of Control Example A lost a significant amount of the phenol-formaldehyde resin coating while the pad of Example 1 lost virtually none. The results of this test show that the poor adhesion of the phenol-formaldehyde resin to the polyester fibers of the web was overcome by using a first coating of the melamine-formaldehyde/plasticized polyvinyl chloridevinyl acetate resin.

EXAMPLE 2

A low density, pre-bonded, nonwoven web was formed in a manner identical to that described in Example 1, with the exception that the pre-bonded web weighed about 470g/m$^2$ and was composed of 75% by weight, 40 mm long, 50 denier, crimped polyester staple fibers having about 8 crimps per 25 mm, and 25% by weight of the 15 denier, melt-bondable polyester fibers described in Example 1. The pre-bonded web was then coated, via a two roll coater, with a mixture composed of 2000 parts Cymel 303 resin composition, 160 parts of a 50% solids solution in water of p-toluene sulfonic acid, 2000 parts of the vinyl resin/plasticizer dispersion described in Example 1, and 120 parts C15/250 glass microspheres (commercially available from 3M under the trade designation Scotchlite Brand Glass Bubbles). The coated web was then heated as described in Example 1 to cure the binder resin. The resultant bonded and coated nonwoven web weighed about 1050g/m$^2$ and was about 25 mm thick.

Discs, 500 mm in diameter, were cut from the coated web of this example and were then evaluated as a buffing pad on polish coated floor tiles. White, filled vinyl floor tiles, 305 mm by 305 mm, were individually cleaned to remove any previously applied coatings. These floor tiles were then coated with six coats of a floor polish, commercially available from 3M under the trade designation Stellar Brand Floor Polish, with about 30 minutes allowed between coats for drying. The polish coated floor tiles were then allowed to dry at room temperature for four days before being used in this test. These polish coated floor tiles had 60° gloss values ranging from about 87 to 90, as measured per ASTM D1455-82. After drying, the polish coated surfaces of the floor tiles were then scuffed to controllably simulate foot traffic dulling of the polished coated surface of the floor tiles. The individual coated tiles were placed in a matrix between other tiles and the polished surfaces were controllably scuffed to reduce the 60° gloss to a value ranging from about 56 to 58, by cleaning them with a somewhat abrasive floor pad (commercially available from 3M under the trade designation Scotch-Brite Brand Blue Cleaner) mounted on a 175 RPM rotary floor polishing machine.

The 500 mm diameter nonwoven floor polishing pad of the invention was fitted onto a battery powered high speed floor polishing machine which operated at 2500 RPM (commercially available from Advance Machine Company under the trade designation Whirlamatic). After one pass over the polish coated floor tiles, at the rate of about 45 m/minute, the nonwoven floor polishing pad of the invention increased the 60° gloss value to 79, and after a second pass the 60° gloss was further increased slightly to 82. In comparison, when a commercially available natural hair floor polishing pad was used on the high speed floor polishing machine, the 60° gloss was only increased to 71 on the first pass, and after a second pass the 60° gloss was only increased to 72. The results of this test show the ability of the nonwoven floor polishing pad of the invention to more quickly, with fewer passes and less effort, increase the gloss of polish coated floor tiles to the high reflective levels now desired.

EXAMPLE 3

A low density, pre-bonded, nonwoven web was formed in a manner identical to that described in Example 1, with the exception that the pre-bonded web weighed 210 g/m$^2$, was 20 mm thick, and was composed of 70% by weight, 60 mm long, 50 denier, crimped polyester (polyethylene terephthalate) staple fibers, having 5 crimps per 25 mm, and 30% by weight of the 15 denier melt-bondable polyester fibers described in Example 1.

The pre-bonded web was then coated, using a two-roll coater as described in Example 1, with a mixture composed of 250 parts Cymel 303 resin composition, 20 parts of a 50% solids solution in water of p-toluene sulfonic acid, and 500 parts of a vinyl resin/plasticizer dispersion composed of 313 parts of the vinyl chloride/-vinyl acetate copolymer used in Example 1 and 187 parts diisononyl phthalate. The liquid coating was applied at a weight of about 375g/m$^2$ Prior to heating to cure the coating, ground particles of polymethylmethacrylate, having a screen grade size of between 24 and 42 (having a particle diameter between about 0.71 mm and 0.35 mm), were drop coated onto one side of the nonwoven web so as to cover about 70% of the surface. The coating was then cured at 160° C. for 10 minutes. The product of this example performed well as a non-scratch kitchen scouring pad.

EXAMPLES 4–16

In Examples 4–16 samples of potential primary binder resin compositions were prepared, and evaluated for compatibility and suitability. The amount and type of melamine-formaldehyde reson and plasticized vinyl resin, were varied as shown below in Table I. The vinyl resin used in Examples 4–15 was the vinyl chloride-vinyl acetate copolymer described in Example 1. In Example 16 the vinyl resin was a vinyl chloride homopolymer.

TABLE I

| | Melamine-Formaldehyde Resin | | Plasticized Polyvinyl Chloride Resin | | | |
|---|---|---|---|---|---|---|
| Example | Cymel | Wt. % | Wt. % | % PVC | % Plasticizer | Comments |
| 4 | None | None | 100 | 57.1 | 42.9 | Too soft & flexible |
| 5 | 303 | 16.7 | 83.3 | 57.1 | 42.9 | Too soft |
| 6 | 303 | 37.5 | 62.5 | 57.1 | 42.9 | Tougher than Example 5 |
| 7 | 303 | 50 | 50 | 57.1 | 57.1 | Tough, rigid |
| 8 | 303 | 67 | 33 | 57.1 | 57.1 | Too brittle |
| 9 | 303 | 50 | 50 | 62.6 | 37.4 | Slightly harder harder than Example 7 |
| 10 | 303 | 33 | 67 | 62.6 | 37.4 | Tough, rigid |
| 11 | 327 | 50 | 50 | 57.1 | 42.9 | Incompatible |
| 12 | 380 | 50 | 50 | 57.1 | 42.9 | Incompatible |
| 13 | 1170 | 50 | 50 | 57.1 | 42.9 | Incompatible |
| 14 | 1133 | 50 | 50 | 57.1 | 42.9 | Tough, rigid |
| 15 | 1168 | 50 | 50 | 57.1 | 42.9 | Tough, rigid |
| 16 | 303 | 50 | 50 | 57.1 | 42.7 | Tough, rigid |

The results shown in Table I for Examples 4–16 indicate that only a select group of melamine-formaldehyde resins are sufficiently compatible with the plasticized vinyl resins to be useful in the primary binder resin of the invention. Notably, melamine-formaldehyde resins commercially available from the American Cyanamide Company under the trade designations Cymel 303, Cymel 1133, and Cymel 1168 were found compatible while those sold under the trade designations Cymel 327, Cymel 380 and Cymel 1170 were incompatible. Furthermore, the results indicate that there is a minimum level of amine-formaldehyde resin required, below which the primary binder resin will be too soft to be useful in the invention, as well as a maximum level of amine-formaldehyde resin, above which the primary binder resin will be too brittle to be useful in the invention.

What is claimed is:

1. A flexible and resilient, fibrous, surface treating article comprising an open, lofty, nonwoven fibrous web formed of entangled, synthetic, organic fibers bonded together at points where they contact one another by a cured, tough, fracture resistant, substantially homogeneous, primary binder resin comprising plasticized vinyl resin and polymerized amine-formaldehyde derivative.

2. The flexible and resilient, fibrous, surface treating article of claim 1 wherein said synthetic organic fibers are crimped staple fibers selected from the group consisting of nylon and polyester.

3. The flexible and resilient, fibrous, surface treating article of claim 1 wherein said plasticized vinyl resin is selected from the group consisting of plasticized homopolymers of vinyl chloride and plasticized copolymers of vinyl chloride with vinyl acetate.

4. The flexible and resilient, fibrous, surface treating article of claim 1 wherein said amine-formaldehyde derivative is the product of reacting formaldehyde with a polyamine functional material selected from the group consisting of melamine, urea and benzoguanamine.

5. The flexible and resilient, fibrous, surface treating article of claim 1 wherein said polymerized amine-formaldehyde derivative and said plasticized vinyl resin are present in said primary binder resin in amounts providing a weight ratio of the polymerized amine-formaldehyde derivative to the plasticized vinyl resin in the range of about 30:70 to about 65:35.

6. The flexible and resilient, fibrous, surface treating article of claim 5 wherein said weight ratio of the polymerized amine-formaldehyde derivative to the plasticized vinyl resin is in the range from about 40:60 to about 60:40.

7. The flexible and resilient, fibrous, surface treating article of claim 1 wherein said plasticized vinyl resin has a weight ratio of plasticizer to vinyl resin in the range from about 30:70 to about 60:40.

8. The flexible and resilient, fibrous, surface treating article of claim 7 wherein said weight ratio of plasticizer to vinyl resin is in the range from about 35:60 to about 55:45.

9. The flexible and resilient, fibrous, surface treating article of claim 1 further comprising abrasive particles dispersed throughout and adhered to said organic fibers.

10. A flexible and resilient, fibrous, surface treating article comprising an open, lofty, nonwoven fibrous web formed of entangled, synthetic, organic fibers bonded together at points where they contact one another by a cured, tough, fracture resistant, substantially homogeneous, primary binder resin, said primary binder resin comprising the product resulting from thermally curing a mixture comprising: (a) a vinyl resin; (b) a plasticizer for said vinyl resin which, upon exposure to elevated temperatures, fuses with said vinyl resin to form a substantially homogeneous plasticized vinyl resin; (c) an amine-formaldehyde derivative which will undergo condensation polymerization under acidic conditions at a temperature below the decomposition temperature of the vinyl resin; and (d) an acid catalyst which initiates said condensation polymerization upon exposure to elevated temperatures below the decomposition temperature of the vinyl resin.

11. The flexible and resilient, fibrous, surface treating article of claim 10 wherein said synthetic organic fibers are crimped staple fibers selected from the group consisting of nylon and polyester.

12. The flexible and resilient, fibrous, surface treating article of claim 10 wherein said vinyl resin is selected from the group consisting of homopolymers of vinyl chloride and copolymers of vinyl chloride with vinyl acetate.

13. The flexible and resilient, fibrous, surface treating article of claim 10 wherein said amineformaldehyde derivative is the product of reacting formaldehyde with a polyamine functional material selected from the group consisting of melamine, urea and benzoguanamine.

14. The flexible and resilient, fibrous, surface treating article of claim 13 wherein said amine-formaldehyde derivative is a fully methylated melamine-formaldehyde resin which has been alkylated with lower molecular weight alkyl groups to the extent that it has a very low free methylol content.

15. The flexible and resilient, fibrous, surface treating article of claim 10 wherein said acid catalyst is selected from:

(a) a strong acid; and (b) a compound that will generate a strong acid upon heating to an elevated temperature below the decomposition temperature of the vinyl resin.

16. The flexible and resilient, fibrous, surface treating article of claim 10 wherein said acid catalyst is selected from the group consisting of benzene sulfonic acid, p-toluene sulfonic acid, formic acid, trifluoroacetic acid and tribromoacetic acid.

17. The flexible and resilient, fibrous, surface treating article of claim 10 wherein said amine-formaldehyde derivative, vinyl resin and plasticizer are present in said mixture in amounts providing a weight ratio of the amine-formaldehyde derivative to the total of the vinyl resin plus plasticizer in the range from about 30:70 to about 65:35.

18. The flexible and resilient, fibrous, surface treating article of claim 17 wherein said weight ratio of the amine-formaldehyde derivative to the total of the vinyl resin plus plasticizer is in the range from about 40:60 to about 60:40.

19. The flexible and resilient, fibrous, surface treating article of claim 10 wherein said plasticizer and said vinyl resin are present in said mixture in amounts providing a weight ratio of the plasticizer to the vinyl resin in the range of from about 30:70 to about 60:40.

20. The flexible and resilient, fibrous, surface treating article of claim 19 wherein said weight ratio of the plasticizer to the vinyl resin is in the range of from about 35:60 to about 55:45.

21. The flexible and resilient, fibrous, surface treating article of claim 10 further comprising abrasive particles dispersed throughout and adhered to said organic fibers by said primary binder resin.

22. The flexible and resilient, fibrous, surface treating article of claim 10 further comprising abrasive particles dispersed throughout and adhered to said organic fibers by a cured secondary binder resin.

23. The flexible and resilient, fibrous, surface treating article of claim 22 wherein said secondary binder resin is a phenol formaldehyde resin.

24. A flexible and resilient, fibrous, surface treating article comprising an open, lofty, nonwoven fibrous web formed of entangled, crimped, polyester, staple fibers bonded together at points where they contact one another by a cured, tough, fracture resistant, substantially homogeneous, primary binder resin, said primary binder resin comprising the product resulting from thermally curing a mixture comprising:

(a) a vinyl resin selected from the group consisting of homopolymers of vinyl chloride and copolymers of vinyl chloride with vinyl acetate;

(b) a plasticizer for said vinyl resin which, upon exposure to elevated temperatures, fuses with said vinyl resin to form a substantially homogeneous plasticized vinyl resin;

(c) a fully methylated melamine-formaldehyde resin which has been alkylated with lower molecular weight alkyl groups to the extent that it has a very low free methylol content; and (d) an acid selected from the group consisting of benzene sulfonic acid, p-toluene sulfonic acid, formic acid, trifluoroacetic acid and tribromoacetic acid.

25. The flexible and resilient, fibrous, surface treating article of claim 24 further comprising particles of abrasive material dispersed throughout and adhered to the fibers of said web.

* * * * *